US007263960B2

(12) United States Patent
Saito et al.

(10) Patent No.: US 7,263,960 B2
(45) Date of Patent: Sep. 4, 2007

(54) ENGINE DECOMPRESSION SYSTEM

(75) Inventors: Shigeru Saito, Saitama (JP); Takashi Suzuki, Saitama (JP); Hiroshi Moriyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/347,570

(22) Filed: Feb. 6, 2006

(65) Prior Publication Data

US 2006/0185638 A1 Aug. 24, 2006

(30) Foreign Application Priority Data

Feb. 21, 2005 (JP) ..... 2005-044078

(51) Int. Cl.
*F01L 3/08* (2006.01)

(52) U.S. Cl. ..... 123/182.1

(58) Field of Classification Search ..... 123/182.1
See application file for complete search history.

(56) References Cited

U.S. PATENT DOCUMENTS

| | | | | |
|---|---|---|---|---|
| 3,381,676 | A | 5/1968 | Campen | |
| 3,511,219 | A * | 5/1970 | Esty | 123/182.1 |
| 4,892,068 | A * | 1/1990 | Coughlin | 123/182.1 |
| 4,977,868 | A * | 12/1990 | Holschuh | 123/182.1 |
| 5,711,264 | A | 1/1998 | Jezek et al. | |
| 5,943,992 | A | 8/1999 | Kojima et al. | |
| 6,269,786 | B1 * | 8/2001 | Snyder et al. | 123/182.1 |
| 6,394,054 | B1 * | 5/2002 | Rado et al. | 123/182.1 |
| 6,439,187 | B1 * | 8/2002 | Dietz et al. | 123/182.1 |
| 6,895,918 | B1 * | 5/2005 | Hiraga | 123/182.1 |
| 2002/0108595 | A1 | 8/2002 | Gracyalny | |
| 2003/0188707 | A1 | 10/2003 | Takada et al. | |
| 2006/0272607 | A1 * | 12/2006 | Grybush | 123/182.1 |

FOREIGN PATENT DOCUMENTS

| | | |
|---|---|---|
| EP | 0 407 699 A1 | 1/1991 |
| EP | 0 411 238 A | 2/1991 |
| JP | 51-41974 | 10/1976 |

* cited by examiner

*Primary Examiner*—Stephen K. Cronin
*Assistant Examiner*—Arnold Castro
(74) *Attorney, Agent, or Firm*—Arent Fox LLP

(57) ABSTRACT

An engine decompression system that can secure a projecting height of a decompression cam from a base face of a valve operating cam to be relatively large in an engine starting rotational region, and maintain a state in which the projection height is decreased in a complete combustion rotational region of the engine. The decompression system includes a decompression cam shaft provided on a valve operating cam shaft or a rotating member integrally coupled thereto, the decompression cam shaft being capable of rotating between an operating position in which a decompression cam projects above a base face of a valve operating cam to slightly open engine valves during a compression stroke and a release position in which the decompression cam is withdrawn to allow the engine valves to close. A centrifugal mechanism connected to the decompression cam shaft maintains the decompression cam shaft at an operating position in a starting rotational region, and rotates the decompression cam shaft to the release position in a normal running region. The centrifugal mechanism is arranged so that, in a complete combustion rotational region between the starting rotational region and the normal running region, the decompression cam shaft is maintained at a middle position at which the projection height of the decompression cam is less than the projection height at the operating position.

10 Claims, 10 Drawing Sheets

L2>L1

ENGINE DECOMPRESSION SYSTEM

RELATED APPLICATION DATA

The present application is based upon Japanese priority application No. 2005-44078, filed Feb. 21, 2005, which is hereby incorporated in its entirety herein by reference.

BACKGROUND OF THE INVENTION

1. Field of the Invention

The present invention relates to an improvement of an engine decompression system in which a decompression cam shaft is provided on a valve operating cam shaft equipped with a valve operating cam for opening and closing an engine valve or is provided on a rotating member integrally connected to the valve operating cam shaft. The decompression cam shaft is capable of rotating between an operating position in which a decompression cam projects above a base face of the valve operating cam so as to slightly open the engine valve during an engine compression stroke, and a release position in which the decompression cam is withdrawn beneath the base face so as to allow the engine valve to close. A centrifugal mechanism is connected to the decompression cam shaft to maintain the decompression cam shaft at the operating position in an engine starting rotational region, and to rotate the decompression cam shaft to the release position in a normal running region.

2. Description of the Related Art

Engine decompression systems are already known as disclosed in, for example, Japanese Utility Model Registration Publication No. 51-41974. In such a conventional engine decompression system, rotation of a decompression cam shaft from an operating position to a release position is proportionally controlled according to an increase in the rotational speed of the valve operating cam shaft.

However, in the engine decompression system, in order to minimize the cranking load when starting the engine, it is desirable that the projection height of a decompression cam from a base face of a valve operating cam is relatively large, and also in order to stabilize a complete combustion state in the engine, it is desirable that the projection height of the decompression cam is decreased, so that it is difficult for the conventional centrifugal mechanism to satisfy such decompression characteristics.

SUMMARY OF THE INVENTION

The present invention has been accomplished under such circumstances, and it is an object thereof to provide an engine decompression system that can secure a projecting height of a decompression cam from a base face of a valve operating cam to be relatively large in an engine starting rotational region, and maintain a state in which the projection height is decreased in a complete combustion rotational region of the engine.

In order to achieve the above object, according to a first feature of the present invention, there is provided an engine decompression system in which a decompression cam shaft is provided on a valve operating cam shaft equipped with a valve operating cam for opening and closing an engine valve or is provided on a rotating member integrally connected to the valve operating cam shaft. The decompression cam shaft is capable of rotating between an operating position in which a decompression cam projects above a base face of the valve operating cam so as to slightly open the engine valve during an engine compression stroke, and a release position in which the decompression cam is withdrawn beneath the base face so as to allow the engine valve to close. A centrifugal mechanism is connected to the decompression cam shaft to maintain the decompression cam shaft at the operating position in an engine starting rotational region, and to rotate the decompression cam shaft to the release position in a normal running region. The centrifugal mechanism is arranged so that, in a complete combustion rotational region between the engine starting rotational region and the normal running region, the decompression cam shaft is maintained at a middle position in which the projection height of the decompression cam above the base face is less than the projection height at the operating position.

Further, in addition to the first feature, according to a second feature of the present invention, the centrifugal mechanism comprises: a first weight that is connected to the decompression cam shaft via an arm and maintains the decompression cam shaft at the middle position by means of centrifugal force acting on the first weight in the complete combustion rotational region of the engine; a second weight that is axially supported on the valve operating cam shaft or the rotating member integrally connected thereto and rotates the decompression cam shaft from the middle position to the release position by means of centrifugal force acting on the second weight in the normal running region of the engine, wherein an extremity part of the second weight is connected to the first weight; and a return spring that urges the first weight or the second weight in a direction to the operating position of the decompression cam shaft and maintains the decompression cam at the operating position in the engine starting rotational region.

Furthermore, in addition to the second feature, according to a third feature of the present invention, the rotating member is a driven timing gear integrally connected to the valve operating cam shaft; the decompression cam shaft is rotatably supported on the driven timing gear; the first weight connected to the decompression cam shaft is disposed on one side of the driven timing gear; the second weight is disposed on the other side thereof; and an extremity part of the second weight is connected to the first weight through a long hole provided in the driven timing gear.

With the first feature of the present invention, since in the complete combustion rotational region of the engine, the decompression cam shaft is maintained at the middle position in which the projection height of the decompression cam above the base face of the valve operating cam is made less than the projection height at the operating position, it is possible to stabilize the complete combustion state, thus improving the starting characteristics under load. Furthermore, owing to this arrangement, in the engine starting rotational region, the projection height of the decompression cam can be set at a level higher than that of the conventional arrangement and this enables the pressure within a cylinder bore during a compression stroke to be sufficiently decreased and, therefore, not only can the starting operational load be greatly reduced, but it is also possible to prevent dieseling effectively when stopping the engine.

Furthermore, with the second feature of the present invention, by means of the simple arrangement formed from the first weight, the second weight, and the return spring, it is possible to obtain appropriate two-stage decompression characteristics in which the projection height of the decompression cam is made to differ between the starting rotational region and the complete combustion rotational region.

Furthermore, with the third feature of the present invention, the decompression cam shaft and the first and second weights can be supported by utilizing the driven timing gear, and the decompression system can be made compact by disposing the first and second weights on opposite sides of the driven timing gear.

DESCRIPTION OF THE PREFERRED EMBODIMENT

Figure 1:
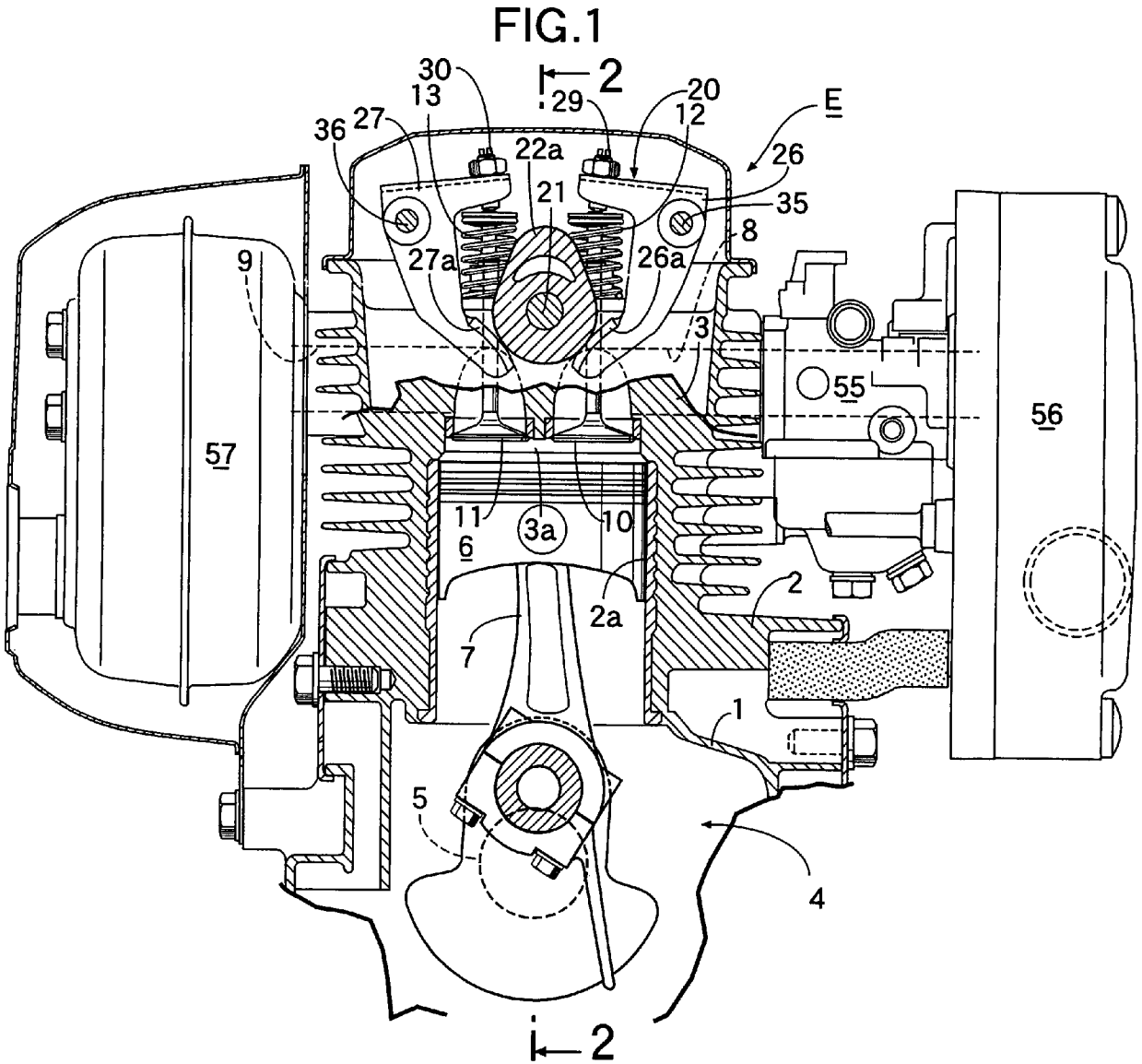
FIG. 1 is a vertical sectional side view of an engine equipped with a decompression system according to the present invention.
Figure 2:
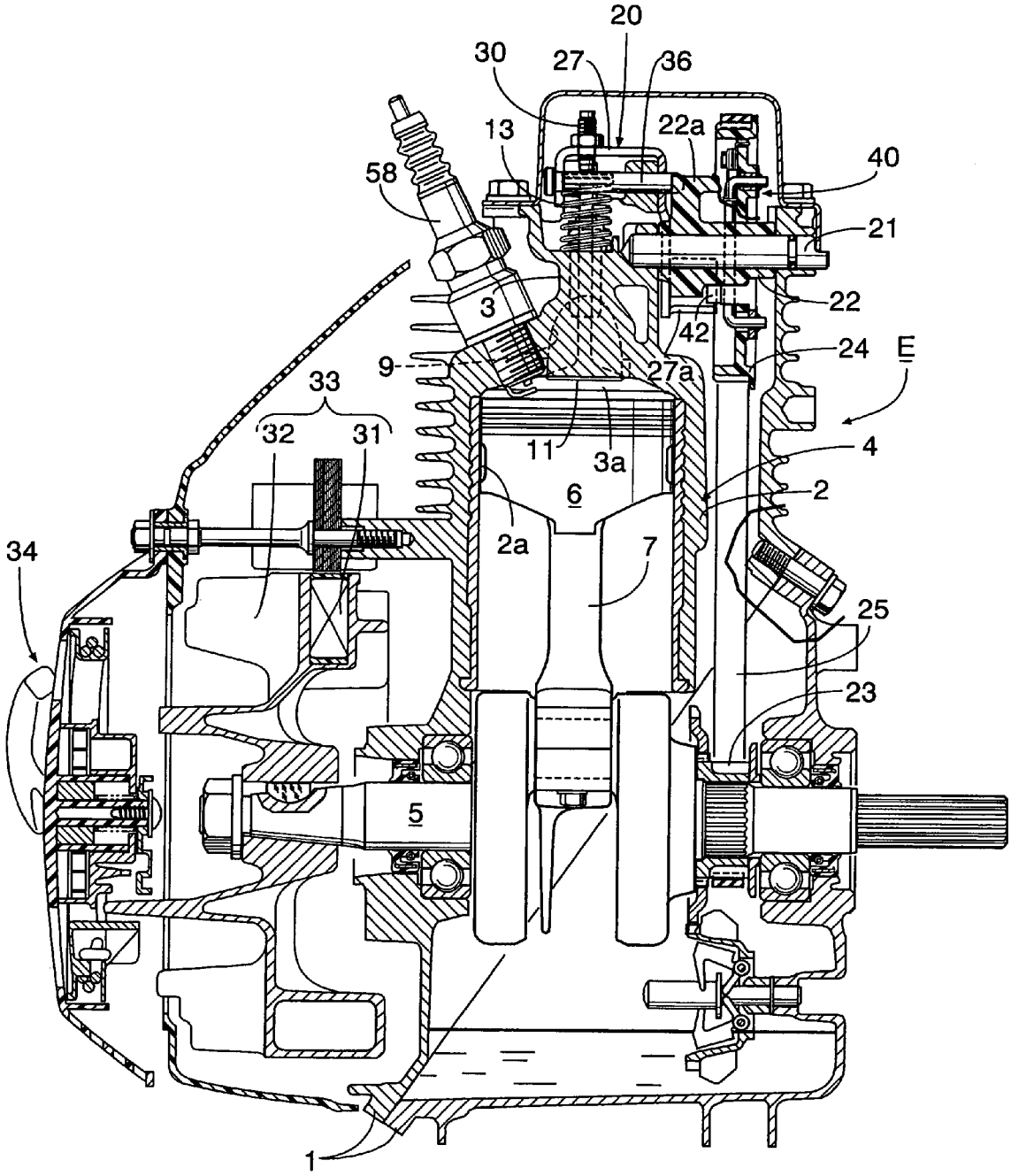
FIG. 2 is a sectional view along line 2-2 in FIG. 1.

Referring first to FIG. 1 and FIG. 2, an engine main body 4 of a four-cycle engine E comprises: a crankcase 1 obliquely divided into two; a cylinder block 2 integrally connected to the upper end of the crankcase 1; and a cylinder head 3 integrally connected to the upper end of the cylinder block 2. A crankshaft 5 is supported on the crankcase 1, and is connected via a connecting rod 7 to a piston 6 that moves up and down within a cylinder bore 2*a* of the cylinder block 2. An intake port 8 and an exhaust port 9 are formed side by side in the cylinder head 3, and open in a combustion chamber 3*a* of the cylinder head 3. An intake valve 10 and an exhaust valve 11 for opening and closing the intake and exhaust ports 8 and 9 are mounted on the cylinder head 3. The intake valve 10 and the exhaust valve 11 are urged in a valve-closing direction by means of corresponding valve springs 12 and 13.

A valve operating mechanism 20 is provided on the cylinder head 3 to cause the intake valve 10 and the exhaust valve 11 to open and close. This valve operating mechanism 20 is explained by reference to FIG. 3 and FIG. 4 together.

The valve operating mechanism 20 includes a support shaft 21 that is mounted on the cylinder head 3 in parallel to the crankshaft 5, and a valve operating cam shaft 22 rotatably supported on the support shaft 21. The valve operating cam shaft 22 has a valve operating cam 22*a* at one end part and a driven timing gear 24 formed integrally with the other end part. A timing belt 25 is wound around the driven timing gear 24 and a drive timing gear 23 secured to the crankshaft 5. The crankshaft 5 drives the valve operating cam shaft 22 at a reduction ratio of 1/2 via the drive timing gear 23, timing belt 25, and driven timing gear 24.

Further, an intake rocker arm 26 and an exhaust rocker arm 27 are swingably mounted on the cylinder head 3 via a pair of rocker shafts 35 and 36, the intake rocker arm 26 and the exhaust rocker arm 27 being disposed symmetrically on radially opposite sides of the valve operating cam shaft 22. These intake and exhaust rocker arms 26 and 27 are hook-shaped, and include: valve head gap adjustment bolts 29 and 30 screwed in their one ends so as to abut against head parts of the intake and exhaust valves 10 and 11; and slippers 26*a* and 27*a* formed on the other end of the rocker arms so as to slidably contact on an outer peripheral face of the valve operating cam 22*a*. The intake and exhaust rocker arms 26 and 27 swing by rotation of the valve operating cam 22*a*, and open and close the intake and exhaust valves 10 and 11 respectively in cooperation with the valve springs 12 and 13.

A flywheel 33 integrally includes a generator rotor 31 and a cooling fan 32, and is secured to one end part of the crankshaft 5. A known recoil type starter 34 (see FIG. 2) capable of cranking the crankshaft 5 via the flywheel 33 is mounted on the engine main body 4. The other end part of the crankshaft 5 serves as an output part.

A decompression system 40 of the present invention is provided on the valve operating cam shaft 22, and extends from the valve operating cam 22*a* to the driven timing gear 24.

The decompression system 40 is explained by reference to FIG. 3 to FIG. 6.

Figure 3:
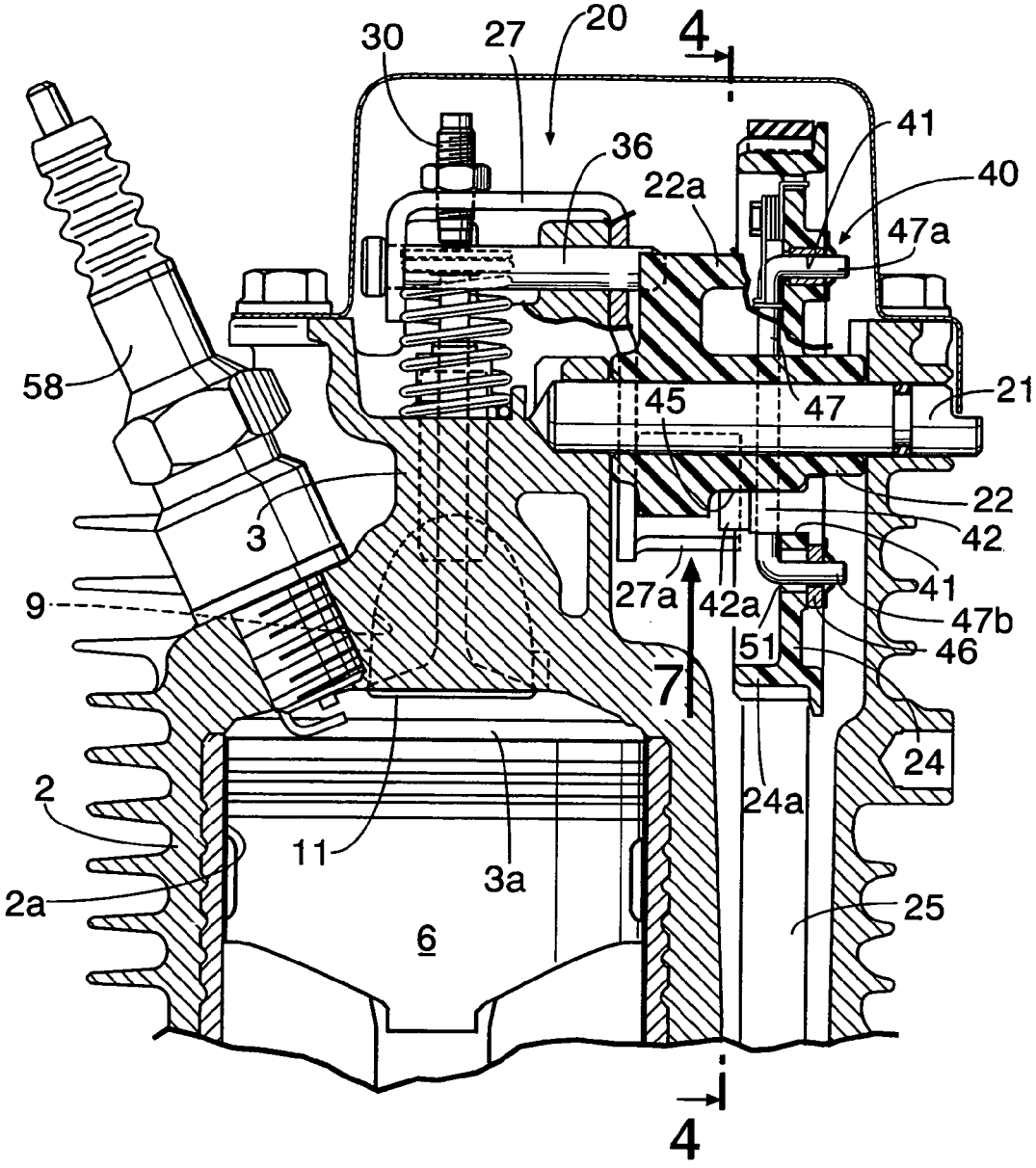
FIG. 3 is an enlarged view of an essential part of FIG. 2.
Figure 4:
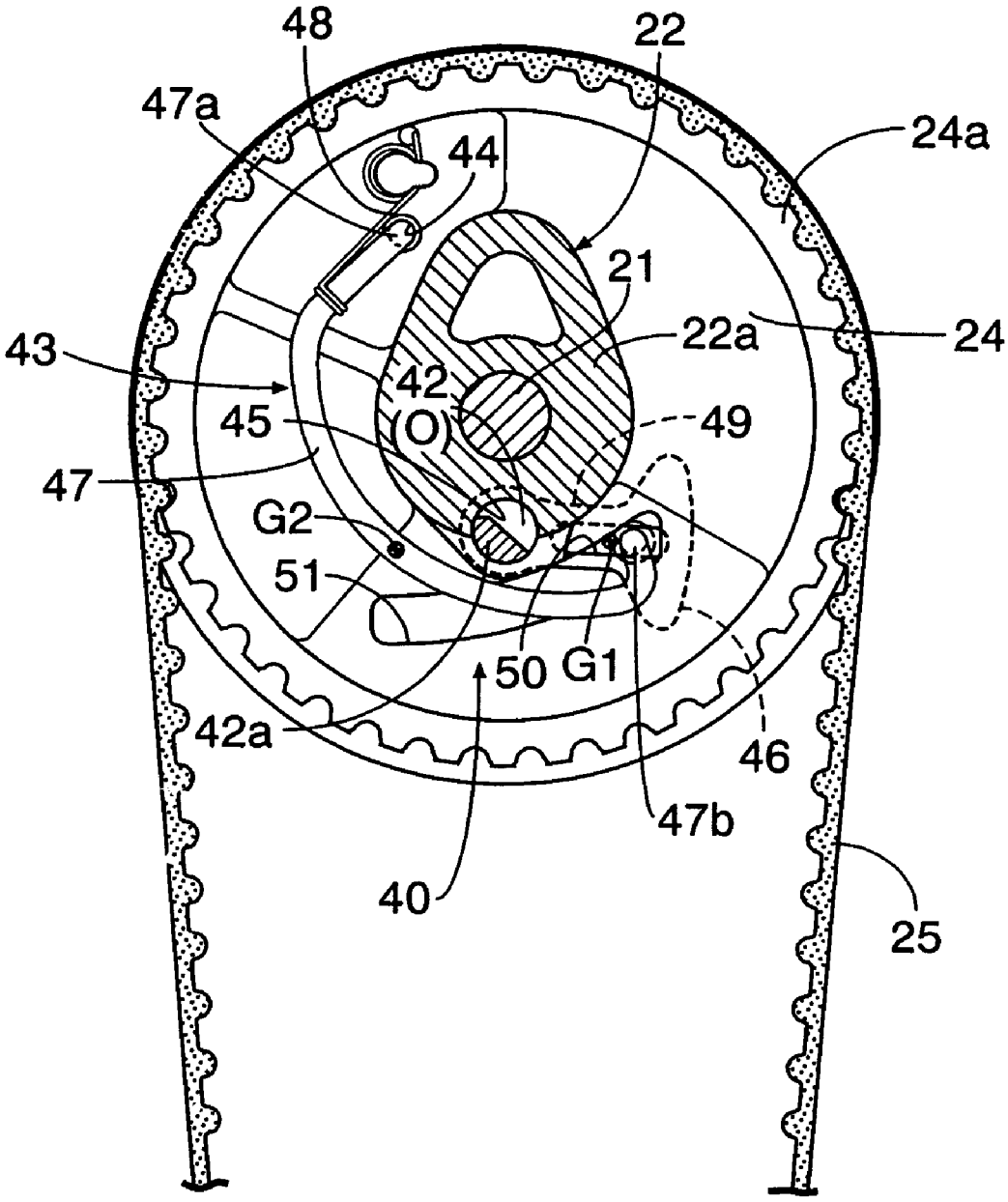
FIG. 4 is a sectional view along line 4-4 in FIG. 3 (showing a state in which a decompression cam shaft is at an operating position).

In FIG. 3 and FIG. 4, the decompression system 40 comprises a decompression cam shaft 42 and a centrifugal mechanism 43 for operating the decompression cam shaft 42. The decompression cam shaft 42 is rotatably supported in a bearing hole 41 formed in the driven timing gear 24 so as to be parallel to the valve operating cam shaft 22. The decompression cam shaft 42 extends to both inner and outer sides of the driven timing gear 24. A decompression cam 42*a* having a half-moon shaped section is formed on an inner end part of the decompression cam shaft 42 extending to the inner side. The decompression cam shaft 42 is capable of rotating from an operating position O (see FIG. 4) at which an arc face of the decompression cam 42*a* projects above a base face of the valve operating cam 22*a* to a maximum degree, via a middle position M (see FIG. 5) at which the projection height of the decompression cam 42*a* above the base face (hereinafter, simply called the projection height of the decompression cam 42*a*) is made less than the projection height at the operating position O, to a release position N at which the projection height of the decompression cam 42*a* is made zero (see FIG. 6). At the release position N of the decompression cam shaft 42, the decompression cam 42*a* sinks into a depression 45 formed in the valve operating cam 22*a*, and the projection height of the decompression cam 42*a* becomes zero.

Figure 7:
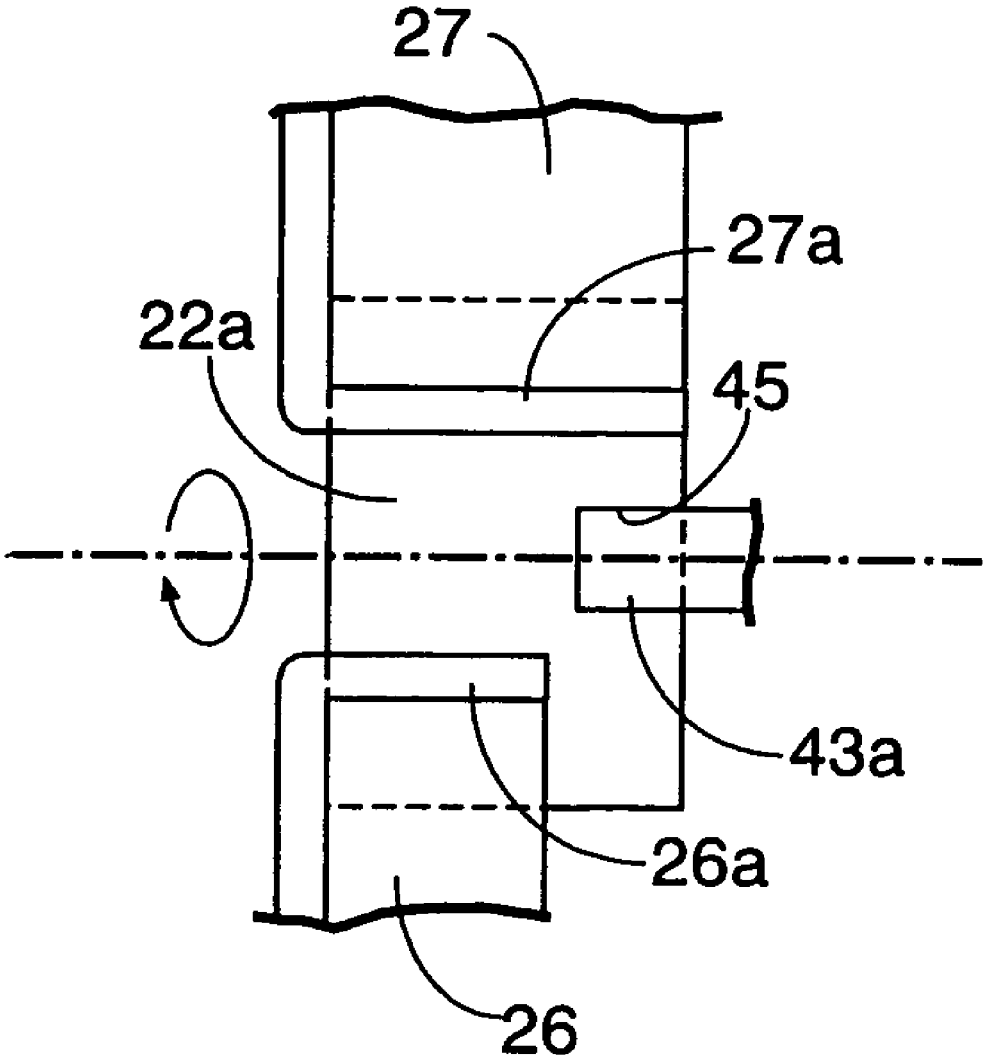
FIG. 7 is a view from arrow 7 in FIG. 3.

As shown in FIG. 7, the depression 45 is provided in a portion of the base face of the valve operating cam 22*a* with which a part of the slipper 27*a* of the exhaust rocker arm 27 comes into sliding contact while avoiding a portion with which the slipper 26*a* of the intake rocker arm 26 comes into sliding contact. Therefore, the decompression cam 42*a* disposed in the depression 45 opens only the exhaust valve 11 via the exhaust rocker arm 27 when it projects.

Figure 8:
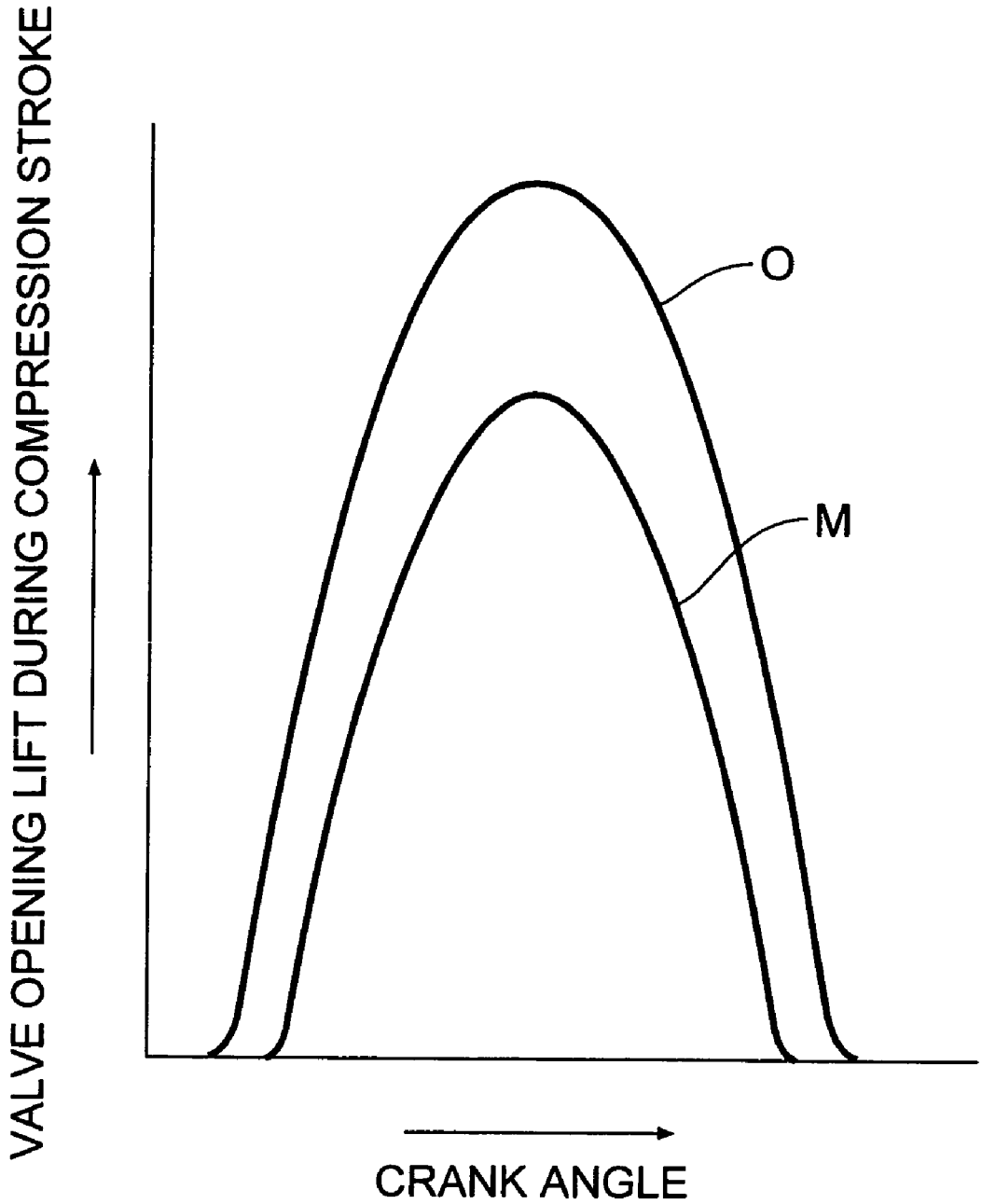
FIG. 8 is a graph showing the characteristics of opening an exhaust valve by a decompression cam.

FIG. 8 shows valve-opening characteristics of the exhaust valve 11 when the decompression cam shaft 42 is at the operating position O and the middle position M. That is, when the decompression cam shaft 42 is at the operating position O, the valve opening lift and the valve opening period of the exhaust valve 11 due to the decompression cam 42*a* become a maximum, and at the middle position M, the valve opening lift and the valve opening period of the exhaust valve 11 due to the decompression cam 42*a* decrease.

The centrifugal mechanism 43 comprises: a first weight 46 that predominantly rotates the decompression cam shaft 42 from the operating position O to the middle position M by means of centrifugal force acting on itself; a second weight 47 predominantly rotates the decompression cam shaft 42 from the middle position M to the release position N by means of centrifugal force acting on itself; and a return spring 48 that urges the first weight 46 or the second weight 47 toward the operating position O of the decompression cam shaft 42.

The first weight 46 is integrally connected, via an arm 49, to an outer end part of the first decompression cam shaft 42 projecting on the outer side of the driven timing gear 24. When the decompression cam shaft 42 is at the operating position O, the center of gravity G1 of the first weight 46 deviates from a radius line R of the driven timing gear 24 running through the axis of the decompression cam shaft 42; and when the decompression cam shaft 42 rotates to the predetermined middle position M between the operating position O and the release position N, the center of gravity G1 lies on the radius line R. The center of gravity G1 of the first weight 46 lying on the radius line R means that a distance L1 from the axis of the valve operating cam shaft 22 to the center of gravity G1 becomes a maximum.

In the second weight 47, a shaft-shaped base portion 47*a* is rotatably fitted into a support hole 44 of the driven timing gear 24, and a pin-shaped extremity part 47*b* is slidably engaged with a long coupling hole 50 formed so as to extend from the arm 49 to the first weight 46. In this way, the first and second weights 46 and 47 are operatively connected to each other throughout the entire rotational range from the operating position O to the release position N of the decompression cam shaft 42.

The second weight 47 is formed from a single steel wire, curved like a bow so as to surround half of the periphery of the valve operating cam shaft 22 on the inner side of the driven timing gear 24, and gives a torque toward the release position N, via the first weight-46, to the decompression cam shaft 42 by means of centrifugal force acting on the center of gravity G2 of the second weight 47. The release position N of the decompression cam shaft 42 is defined by the second weight 47 swinging radially outward to abut against the inner peripheral face of a rim portion 24*a* of the driven timing gear 24.

The weight of the second weight 47 is set to be smaller than that of the first weight 46, and the distance L1 from the axis of the valve operating cam shaft 22 to the center of gravity G1 of the first weight 46 is always smaller than the distance L2 from the same axis to the center of gravity G2 of the second weight 47.

In the illustrated example, the return spring 48 is provided in a tensioned state, with a predetermined set load, between the second weight 47 and the driven timing gear 24, thereby urging the second weight 47 toward the operating position o of the decompression cam shaft 42.

As described above, the first and second weights 46 and 47, which are disposed on the inner and outer sides of the driven timing gear 24, are housed on the inner peripheral side of the rim portion 24*a* of the gear driven timing gear 24. In order to enable these weights 46 and 47 to be operatively connected to each other, the driven timing gear 24 is provided with an arc-shaped long hole 51 with the support hole 44 as its center, and the pin-shaped extremity part 47*b* of the second weight 47 is engaged with the coupling hole 50 of the first weight 46 through the long hole 51.

In FIG. 1, reference numeral 55 denotes a carburetor, 56 denotes an air cleaner, and 57 denotes an exhaust muffler, and in FIG. 2, reference numeral 58 denotes an ignition plug.

The operation of this embodiment is now explained.

As shown in FIG. 4, in the engine starting rotational region, the return spring 48 maintains, by means of the urging force, the decompression cam shaft 42 at the operating position O via the first and second weights 46 and 47. Therefore, the projection height of the decompression cam 42*a* of the decompression cam shaft 42 becomes a maximum.

When the recoil type starter 34 is manually operated to crank the crankshaft 5 in order to start the engine E, the decompression cam 42*a* pushes the slipper 27*a* of the exhaust rocker arm 27 to slightly open the exhaust valve 11 in a compression stroke, so that part of the compressed gas within the cylinder bore 2*a* is released into the exhaust port 9 and the increase in pressure of the cylinder bore 2*a* is relieved. Consequently, the cranking load is reduced, thereby performing a starting operation with ease.

Figure 9:
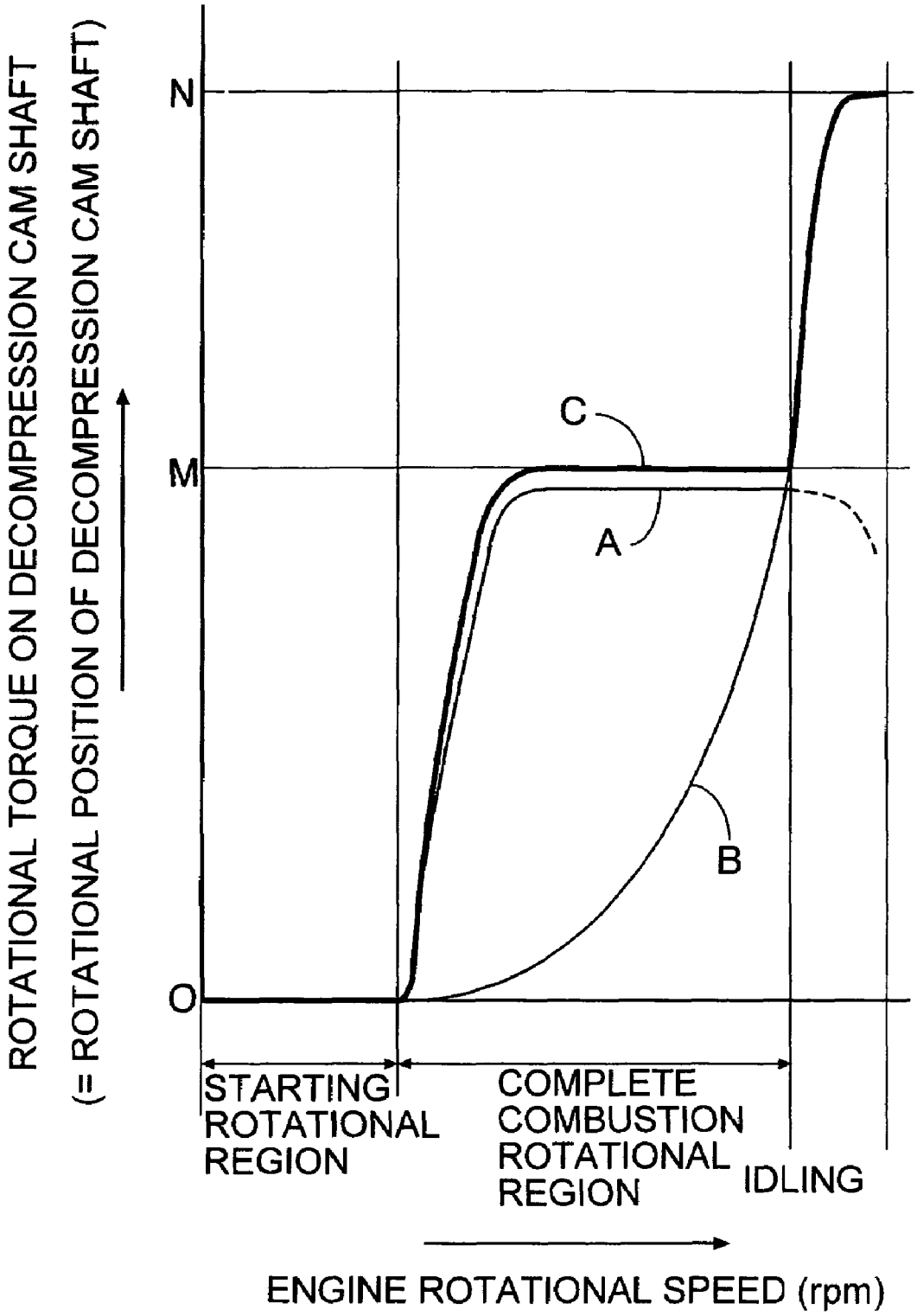
FIG. 9 is a graph showing the relationship between engine rotational speed and rotational torque (rotational position of the decompression cam shaft) toward a release position of the decompression cam shaft due to centrifugal force of first and second weights.

FIG. 9 is a graph showing the relationship between engine rotational speed and rotational torque (=rotational position of the decompression cam shaft 42) toward the release position N of the decompression cam shaft 42 due to the centrifugal force of the first and second weights 46 and 47. In this figure, as shown by line A, the rotational torque of the decompression cam shaft 42 due to the centrifugal force of the first weight 46 increases in response to an increase in the engine rotational speed after starting the engine until the engine rotational speed reaches a complete combustion rotational region; and when it reaches the complete combustion rotational region, the center of gravity G1 of the first weight 46 lies on the radius line R of the driven timing gear 24 running through the axis of the decompression cam shaft 42, that is, the distance L1 from the axis of the decompression cam shaft 42 to the center of gravity G1 becomes a maximum, so that the rotational torque becomes a maintaining torque for maintaining the decompression cam shaft 42 at the middle position M.

On the other hand, since the second weight 47 is lighter than the first weight 46, the rotational torque of the decompression cam shaft 42 due to the centrifugal force of the second weight 47 increases in response to an increase in the engine rotational speed far more slowly than that due to the first weight 46 as shown by line B, but until the engine rotational speed reaches the complete combustion rotational region, the decompression cam shaft 42 is rotated, as shown by line C, toward the middle position M by means of the sum of the rotational torques acting on the decompression cam shaft 42 provided by the centrifugal forces of the first and second weights 46 and 47.

However, since the rotational torque of the decompression cam shaft 42 due to the centrifugal force of the second weight 47 does not catch up with the maintaining torque, due to the centrifugal force of the first weight 46, maintaining the decompression cam shaft 42 at the middle position M even when the engine rotational speed reaches the complete combustion rotational region, the decompression cam shaft 42 is maintained at the middle position M by means of the centrifugal force of the first weight 46 in the complete combustion state.

Figure 5:
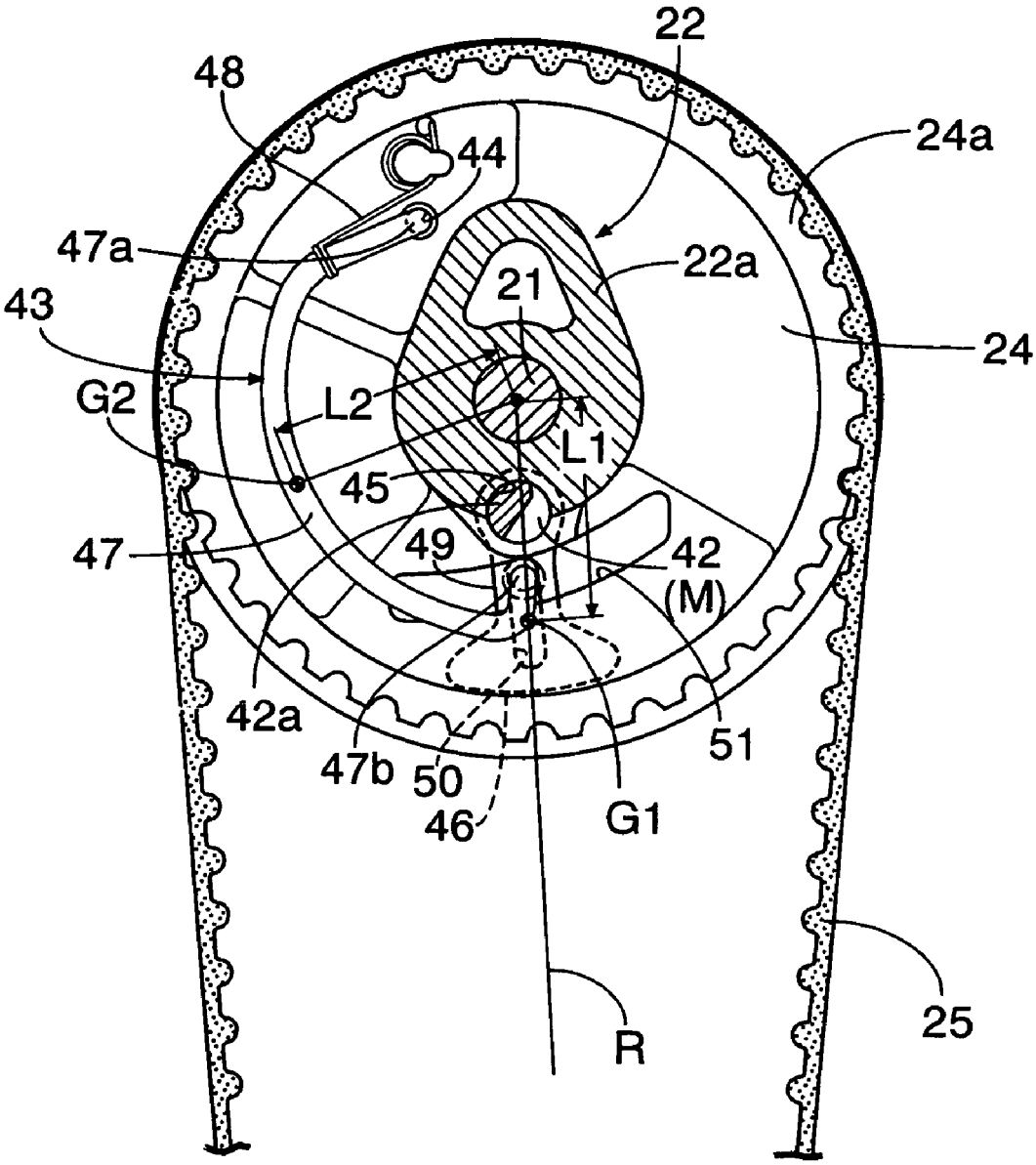
FIG. 5 is a diagram corresponding to FIG. 4 and showing a state in which the decompression cam shaft is at a middle position.

In this way, when the decompression cam shaft 42 is maintained at the middle position M, the projection height of the decompression cam 42*a* is maintained in a decreased state as shown in FIG. 5, and accordingly the valve opening lift and the valve opening period of the exhaust valve 11 decrease. As a result, release of compressed gas from the cylinder bore 2*a* is efficiently suppressed during the engine compression stroke, so that the decrease in pressure within the cylinder bore 2*a* is recovered to an appropriate degree to increase the output of the engine, thereby stabilizing the complete combustion state. Therefore, after starting, even if a load is immediately imposed on the crankshaft 5, the engine does not stop, that is, the starting characteristics under load improve.

Figure 6:
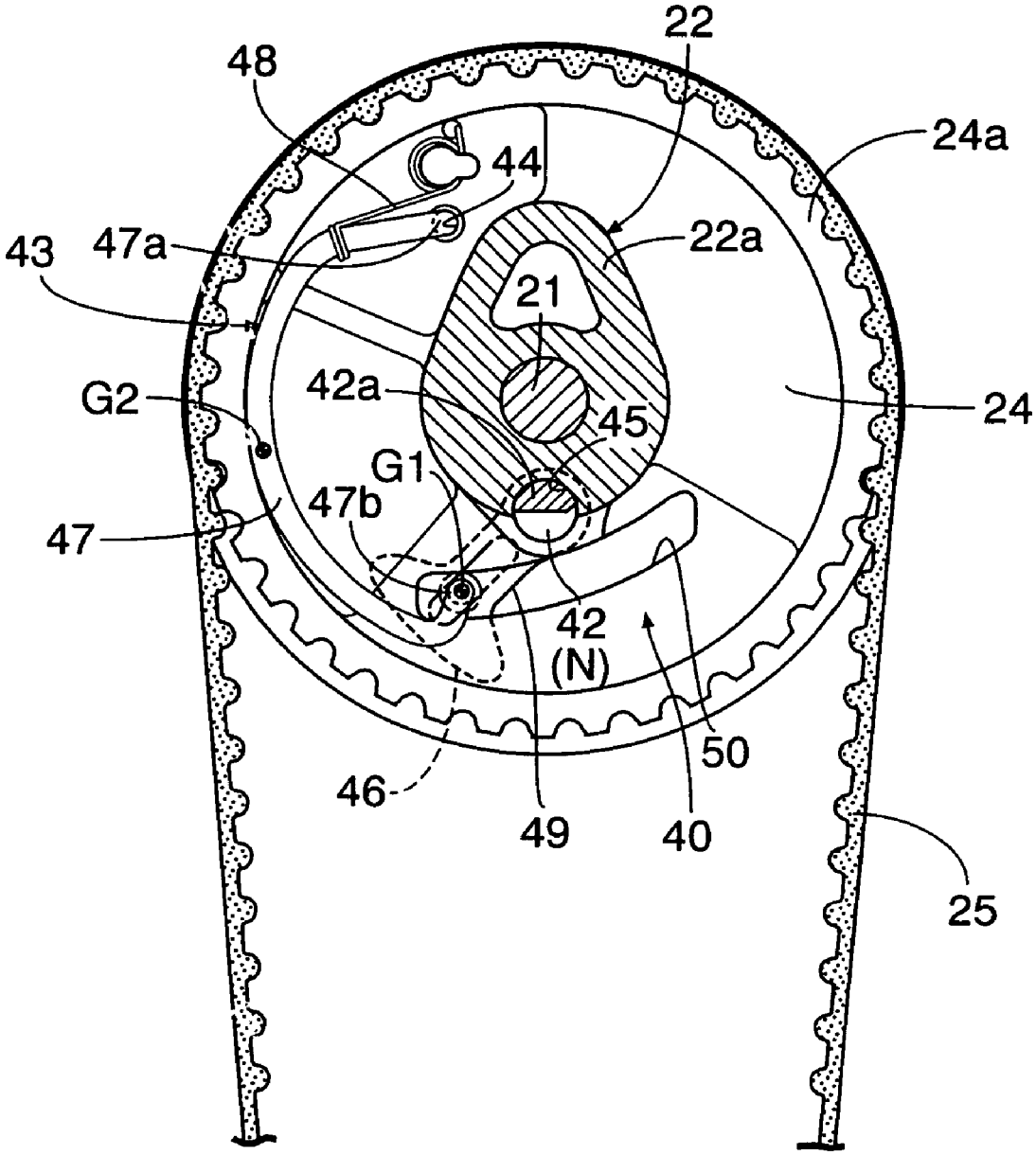
FIG. 6 is a diagram corresponding to FIG. 4 and showing a state in which the decompression cam shaft is at a release position.

About the time when the engine rotational speed exceeds the complete combustion rotational region, by virtue of the changing lever ratio as well as the effect of the distance L2 between the axis of the valve operating cam shaft 22 and the center of gravity G2 of the second weight 47 being larger than the distance between the same axis and the center of gravity G1 of the first weight 46, the rotational torque of the decompression cam shaft 42 due to the centrifugal force of the second weight 47 exceeds the torque, due to the centrifugal force of the first weight 46, maintaining the decompression cam shaft 42 at the middle position M. Accordingly, the decompression cam shaft 42 is rotated again toward the release position N as shown by line C in FIG. 9, and the second weight 47 abuts against the inner peripheral face of the rim portion 24*a* of the driven timing gear 24 before the engine rotational speed reaches the normal idle rotational speed, so that the decompression cam shaft 42 is maintained at the release position N. That is, the decompression cam 42*a* is withdrawn beneath the base face as shown in FIG. 6 to make the projection height zero.

When the engine rotational speed exceeds the complete combustion rotational region and as a result the decompression cam shaft 42 rotates from the middle position M to the release position N, the first weight 46 correspondingly further rotates so that the center of gravity G1 deviates from the radius line R. Thus, the centrifugal force acting on the center of gravity G1 generates a rotational torque (see dotted line part of line A) that attempts to return the decompression cam shaft 42 in the opposite direction, but since the rotational torque of the decompression cam shaft 42 due to the centrifugal force of the second weight 47 in this state far exceeds the above-mentioned rotational torque in the opposite direction, the decompression cam shaft 42 can be reliably rotated to the release position N. Therefore, the centrifugal force of the second weight 47 dominates the rotation of the decompression cam shaft 42 from the middle position M to the release position N.

Under normal running conditions following idling of the engine, the valve operating cam 22*a* can appropriately open and close the intake and exhaust valves 10 and 11 in accordance with the natural cam profile without interference from the decompression cam 42*a*.

Figure 10:
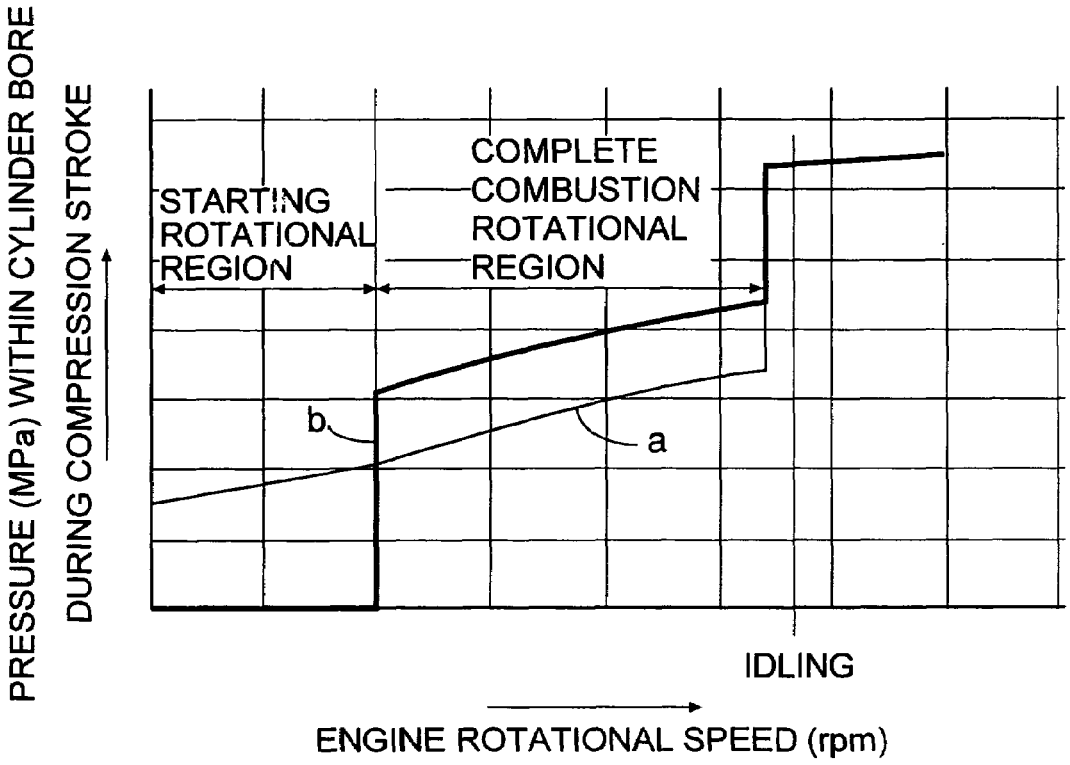
FIG. 10 is a graph showing the relationship between engine rotational speed and pressure within a cylinder during a compression stroke.

FIG. 10 is a graph showing characteristics in the relationship between engine rotational speed and cylinder internal pressure during the compression stroke: a line a shows the characteristics of a conventional decompression system, and a line b shows the characteristics of the decompression system 40 of the present invention. As is apparent from FIG. 10, since the projection height of the decompression cam 42*a* in the complete combustion rotational region of the engine in the present invention is set at a level lower than that of the conventional system, the projection height of the decompression cam 42*a* can be set at a level higher than that of the conventional system when starting the engine. Thus, the pressure within cylinder bore 2*a* can be sufficiently decreased during the compression stroke, whereby not only can the starting operation load be greatly reduced, but also dieseling can be effectively prevented when stopping the engine. Further, in the complete combustion rotational region of the engine, since the reduction of the projection height of the decompression cam 42*a* is maintained, the decrease in pressure within the cylinder bore 2*a* is recovered to an appropriate degree during the compression stroke, thus stabilizing the complete combustion state to improve the starting characteristics under load.

In this way, by the simple arrangement formed from the first weight 46, second weight 47, and return spring 48, it is possible to obtain appropriate two-stage decompression characteristics, that is, the projection height of the decompression cam 42*a* is made to differ between the starting rotational region and the complete combustion rotational region.

Moreover, the decompression cam shaft 42 as well as the first and second weights 46 and 47 are supported by utilizing the driven timing gear 24, and the first and second weights 46 and 47 are disposed on opposite sides of the driven timing gear 24 and on the inner peripheral side of the rim portion 24*a*, thereby making the decompression system compact.

In the above-mentioned embodiment, the decompression cam 42*a* acts on the exhaust rocker arm 27 alone, but it may act on both the intake and exhaust rocker arms 26 and 27 or on the intake rocker arm 26 alone. In this case, since the valve opening lift and the valve opening period of the intake valve 10 decrease at the middle position M of the decompression cam shaft 42 during the compression stroke, backfiring can be effectively suppressed. Further, in the valve operating mechanism 20 of the illustrated example, the valve operating cam 22*a* acts on both the intake and exhaust valves 10 and 11 in common, but intake and exhaust cams may be provided so as to correspond to each of the valves 10 and 11. In this case, it is desirable for the decompression cam 42*a* to be disposed so as to be adjacent to the exhaust cam. Furthermore, the return spring 48 may be provided in a tensioned state between the first weight 46 and the driven timing gear 24.

The present invention is not limited to the above-mentioned embodiment, and the design thereof can be modified in a variety of ways without departing from the subject matter thereof.

What is claimed is:

1. An engine decompression system for an engine having a valve operating cam shaft and a valve operating cam for opening and closing an engine valve, said engine decompression system comprising:

a decompression cam shaft mounted on the operating cam shaft and a decompression cam mounted on the decompression cam shaft, wherein the decompression cam shaft rotates between an operating position in which a decompression cam projects above a base face of the valve operating cam for slightly opening the engine valve during an engine compression stroke, and a release position in which the decompression cam is withdrawn beneath the base face for allowing the engine valve to close; and a centrifugal mechanism connected to the decompression cam shaft to maintain the decompression cam shaft at the operating position during engine starting rotational region, and to rotate the decompression cam shaft to the release position in a normal running region, wherein in a complete combustion rotational region between the engine starting rotational region and the normal running region, the decompression cam shaft is maintained at a substantially constant middle position in which the projection height of the decompression cam above the base face is less than the projection height at the engine starting rotational region, and greater than the projection height at the normal running region.

2. The engine decompression system according to claim 1, wherein the centrifugal mechanism comprises: a first weight including an arm, the first weight being connected to the decompression cam shaft via the arm and maintaining the decompression cam shaft at the middle position by means of centrifugal force acting on the first weight in the complete combustion rotational region of the engine; a second weight axially supported on the valve operating cam shaft for rotating the decompression cam shaft from the middle position to the release position by means of centrifugal force acting on the second weight in the normal running region of the engine, the second weight having an extremity part connected to the first weight; and a return spring for urging at least one of the first weight or the second weight in a direction toward the operating position of the decompression cam shaft and maintaining the decompression cam at the operating position in the engine starting rotational region.

3. The engine decompression system according to claim 2, wherein the rotating member is a driven timing gear integrally connected to the valve operating cam shaft; the decompression cam shaft is rotatably supported on the driven timing gear; the first weight connected to the decompression cam shaft, is disposed on one side of the driven timing gear; the second weight is disposed on the other side thereof, wherein the extremity part of the second weight is connected to the first weight through a long hole provided in the driven timing gear.

4. An engine decompression system for an engine having a valve operating cam shaft, a rotating member coupled to the valve operating cam shaft and a valve operating cam for opening and closing an engine valve, said engine decompression system comprising:

a decompression cam shaft mounted on the rotating member and a decompression cam mounted on the decompression cam shaft, wherein the decompression cam shaft rotates between an operating position in which a decompression cam projects above a base face of the valve operating cam for slightly opening the engine valve during an engine compression stroke, and a release position in which the decompression cam is withdrawn beneath the base face for allowing the engine valve to close; and a centrifugal mechanism connected to the decompression cam shaft to maintain the decompression cam shaft at the operating position during engine starting rotational region, and to rotate the decompression cam shaft to the release position in a normal running region, wherein in a complete combustion rotational region between the engine starting rotational region and the normal running region, the decompression cam shaft is maintained at a substantially constant middle position in which the projection height of the decompression cam above the base face is less than the projection height at the engine starting rotational region, and greater than the projection height at the normal running region.

5. The engine decompression system according to claim 4, wherein the centrifugal mechanism comprises: a first weight including an arm, the first weight being connected to the decompression cam shaft via the arm and maintaining the decompression cam shaft at the middle position by means of centrifugal force acting on the first weight in the complete combustion rotational region of the engine; a second weight axially supported on the rotating member for rotating the decompression cam shaft from the middle position to the release position by means of centrifugal force acting on the second weight in the normal running region of the engine, the second weight having an extremity part connected to the first weight; and a return spring for urging at least one of the first weight or the second weight in a direction toward the operating position of the decompression cam shaft and maintaining the decompression cam at the operating position in the engine starting rotational region.

6. The engine decompression system according to claim 5, wherein the rotating member is a driven timing gear integrally connected to the valve operating cam shaft; the decompression cam shaft is rotatably supported on the driven timing gear; the first weight connected to the decompression cam shaft, is disposed on one side of the driven timing gear; the second weight is disposed on the other side thereof, wherein the extremity part of the second weight is connected to the first weight through a long hole provided in the driven timing gear.

7. An engine decompression system for an engine having a valve operating cam shaft and a valve operating cam for opening and closing an engine valve, said engine decompression system comprising:

a decompression cam shaft mounted on the operating cam shaft and a decompression cam mounted on the decompression cam shaft, wherein the decompression cam shaft rotates between an operating position in which a decompression cam projects above a base face of the valve operating cam for slightly opening the engine valve during an engine compression stroke, and a release position in which the decompression cam is withdrawn beneath the base face for allowing the engine valve to close; and a centrifugal mechanism connected to the decompression cam shaft to maintain the decompression cam shaft at the operating position during engine starting rotational region, wherein the centrifugal mechanism comprises: a first weight including an arm, the first weight being connected to the decompression cam shaft via the arm and maintaining the decompression cam shaft at the middle position by means of centrifugal force acting on the first weight in the complete combustion rotational region of the engine;

a second weight axially supported on the valve operating cam shaft for rotating the decompression cam shaft from the middle position to the release position by means of centrifugal force acting on the second weight in the normal running region of the engine, the second weight having an extremity part connected to the first weight; and a return spring for urging at least one of the first weight or the second weight in a direction toward the operating position of the decompression cam shaft and maintaining the decompression cam at the operating position in the engine starting rotational region, and to rotate the decompression cam shaft to the release position in a normal running region, wherein in a complete combustion rotational region between the engine starting rotational region and the normal running region, the decompression cam shaft is maintained at a middle position in which the projection height of the decompression cam above the base face is less than the projection height at the engine starting rotational region.

8. The engine decompression system according to claim 7, wherein the rotating member is a driven timing gear integrally connected to the valve operating cam shaft; the decompression cam shaft is rotatably supported on the driven timing gear; the first weight connected to the decompression cam shaft, is disposed on one side of the driven timing gear; the second weight is disposed on the other side thereof, wherein the extremity part of the second weight is connected to the first weight through a long hole provided in the driven timing gear.

9. An engine decompression system for an engine having a valve operating cam shaft, a rotating member coupled to the valve operating cam shaft and a valve operating cam for opening and closing an engine valve, said engine decompression system comprising:

a decompression cam shaft mounted on the rotating member and a decompression cam mounted on the decompression cam shaft, wherein the decompression cam shaft rotates between an operating position in which a decompression cam projects above a base face of the valve operating cam for slightly opening the engine valve during an engine compression stroke, and a release position in which the decompression cam is withdrawn beneath the base face for allowing the engine valve to close; and a centrifugal mechanism connected to the decompression cam shaft to maintain the decompression cam shaft at the operating position during engine starting rotational region, wherein the centrifugal mechanism comprises:

a first weight including an arm, the first weight being connected to the decompression cam shaft via the arm and maintaining the decompression cam shaft at the middle position by means of centrifugal force acting on the first weight in the complete combustion rotational region of the engine;

a second weight axially supported on the rotating member for rotating the decompression cam shaft from the middle position to the release position by means of centrifugal force acting on the second weight in the normal running region of the engine, the second weight having an extremity part connected to the first weight; and a return spring for urging at least one of the first weight or the second weight in a direction toward the operating position of the decompression cam shaft and maintaining the decompression cam at the operating position in the engine starting rotational region, and to rotate the decompression cam shaft to the release position in a normal running region, wherein in a complete combustion rotational region between the engine starting rotational region and the normal running region, the decompression cam shaft is maintained at a middle position in which the projection height of the decompression cam above the base face is less than the projection height at the engine starting rotational region.

10. The engine decompression system according to claim 9, wherein the rotating member is a driven timing gear integrally connected to the valve operating cam shaft; the decompression cam shaft is rotatably supported on the driven timing gear; the first weight connected to the decompression cam shaft, is disposed on one side of the driven timing gear; the second weight is disposed on the other side thereof, wherein the extremity part of the second weight is connected to the first weight through a long hole provided in the driven timing gear.

* * * * *